US008057664B2

(12) United States Patent
Brown et al.

(10) Patent No.: US 8,057,664 B2
(45) Date of Patent: Nov. 15, 2011

(54) PROCESS FOR REDUCING BROMINE INDEX OF HYDROCARBON FEEDSTOCKS

(75) Inventors: Stephen H. Brown, Bernardsville, NJ (US); James R. Waldecker, Farmington Hills, MI (US); Khavinet Lourvanij, Houston, TX (US)

(73) Assignee: ExxonMobil Chemical Patents, Inc., Houston, TX (US)

( * ) Notice: Subject to any disclaimer, the term of this patent is extended or adjusted under 35 U.S.C. 154(b) by 245 days.

(21) Appl. No.: 11/281,675

(22) Filed: Nov. 17, 2005

(65) Prior Publication Data

US 2007/0112239 A1 May 17, 2007

(51) Int. Cl.
*C07C 2/02* (2006.01)

(52) U.S. Cl. ..... 208/299; 585/804; 585/805; 585/323; 585/467; 208/295; 208/177; 208/307

(58) Field of Classification Search ..... 585/267, 585/259, 258, 260, 264, 273, 804, 805; 208/299, 208/301, 307
See application file for complete search history.

(56) References Cited

U.S. PATENT DOCUMENTS

| | | | | |
|---|---|---|---|---|
| 4,439,409 | A | 3/1984 | Puppe et al. | |
| 4,665,256 | A | 5/1987 | Dianis et al. | |
| 4,727,209 | A | 2/1988 | Chao | |
| 4,774,379 | A | 9/1988 | Butler et al. | |
| 4,795,550 | A | 1/1989 | Sachtler et al. | |
| 4,826,667 | A | 5/1989 | Zones et al. | |
| 4,849,570 | A | 7/1989 | Bakas et al. | |
| 4,891,458 | A | 1/1990 | Innes et al. | |
| 4,962,256 | A * | 10/1990 | Le et al. | 585/467 |
| 5,081,323 | A | 1/1992 | Innes et al. | |
| 5,118,896 | A | 6/1992 | Steigelmann et al. | |
| 5,146,026 | A | 9/1992 | Berna Tejero et al. | |
| 5,149,894 | A | 9/1992 | Holtermann et al. | |
| 5,157,158 | A | 10/1992 | Berna Tejero et al. | |
| 5,516,954 | A * | 5/1996 | Chang et al. | 585/467 |
| 5,877,370 | A | 3/1999 | Gajda | |
| 5,955,641 | A | 9/1999 | Chen et al. | |
| 6,005,154 | A | 12/1999 | Zones et al. | |
| 6,031,114 | A | 2/2000 | DeVries et al. | |
| 6,080,382 | A | 6/2000 | Lee et al. | |
| 6,096,935 | A | 8/2000 | Schulz et al. | |
| 6,103,215 | A | 8/2000 | Zones et al. | |
| 6,111,158 | A | 8/2000 | Marinangeli et al. | |
| 6,133,497 | A | 10/2000 | Hähn et al. | |
| 6,323,381 | B1 | 11/2001 | Nacamuli et al. | |
| 6,368,496 | B1 | 4/2002 | Brown et al. | |
| 6,500,996 | B1 | 12/2002 | Brown et al. | |
| 6,525,234 | B1 * | 2/2003 | Dandekar et al. | 585/467 |
| 6,781,023 | B2 | 8/2004 | Brown et al. | |
| 7,176,340 | B2 * | 2/2007 | Van Broekhoven et al. | 585/449 |
| 7,214,840 | B2 * | 5/2007 | Lo et al. | 585/323 |

FOREIGN PATENT DOCUMENTS

| | | | |
|---|---|---|---|
| AU | 9856403 | A | 9/1999 |
| CZ | 252248 | B1 | 8/1987 |
| EP | 0 231 860 | | 9/1993 |
| EP | 0 780 458 | | 6/1997 |
| EP | 0 704 416 | | 1/2000 |
| EP | 0 776 876 | | 6/2000 |
| EP | 0 748 305 | | 8/2000 |
| EP | 0 952 962 | | 10/2001 |
| EP | 0 895 976 | | 10/2003 |
| GB | 2279661 | | 1/1994 |
| JP | 4198139 | A | 7/1992 |
| JP | 4253925 | A | 9/1992 |
| WO | 2004/056729 | | 7/2004 |

OTHER PUBLICATIONS

U.S. Appl. No. 11/140,182, filed May 27, 2005, Brown et al.
"Handbook of Petroleum Processing", McGraw-Hill, New York 1996, pp. 4.3-4.26.

* cited by examiner

*Primary Examiner* — Tam M Nguyen
(74) *Attorney, Agent, or Firm* — Andrew B. Griffis

(57) ABSTRACT

The present invention relates to a process for reducing the Bromine Index of a hydrocarbon feedstock having at least 50 wt. % of $C_8$ aromatics, comprising the step of contacting the hydrocarbon feedstock with a catalyst at conversion conditions, wherein the catalyst includes a molecular sieve having a zeolite structure type of MWW.

5 Claims, 2 Drawing Sheets

PROCESS FOR REDUCING BROMINE INDEX OF HYDROCARBON FEEDSTOCKS

FIELD

The present invention relates to a process for reducing the Bromine Index (hereafter BI) of hydrocarbon feedstocks such as aromatic hydrocarbon feedstocks having at least 50 wt. % of $C_8$ aromatics.

BACKGROUND OF INVENTION

Hydrocarbon feedstocks such as aromatic hydrocarbon feedstocks are derived from processes such as naphtha reforming and thermal cracking (pyrolysis). Such feedstocks can be used in a variety of petrochemical processes, such as para-xylene production from an aromatic hydrocarbon feedstock containing benzene, toluene and xylene (BTX), toluene disproportionation, xylene isomerization, alkylation and transalkylation. However, aromatic hydrocarbon feedstocks often contain contaminants comprising bromine-reactive compounds including unsaturated hydrocarbons, such as mono-olefins, multi-olefins and styrenes. These can cause undesirable side reactions in downstream processes. Therefore, these contaminants should be removed from the aromatic hydrocarbon feedstocks before they can be used in other processes.

Improved processes for aromatics production, such as that described in the Handbook of Petroleum Processing, McGraw-Hill, New York 1996, pp. 4.3-4.26, provide increased aromatics yield but also increase the amount of contaminants. For example, the shift from high-pressure semi-regenerative reformers to low-pressure moving bed reformers results in a substantial increase in BI in the reformate streams, which are aromatic hydrocarbon feedstocks for downstream processes. This results in a greater need for more efficient and less expensive methods for removal of hydrocarbon contaminants from aromatic hydrocarbon feedstocks, e.g., reformate streams.

Olefins (mono-olefins and multi-olefins) in aromatic hydrocarbon feedstocks are commercially removed by hydrotreating processes. Commercial hydrotreating catalysts have proved active and stable to substantially convert multi-olefins contained therein to oligomers and to partially convert the olefins to alkylaromatics.

The clay treatment of hydrocarbons is widely practiced in the petroleum and petrochemical industries. Clay catalysts are used to remove impurities from hydrocarbon feedstocks in a wide variety of processes. One of the most common reasons for treating these hydrocarbon feedstocks with a clay catalyst system is to remove undesirable olefins, including both multi-olefins and mono-olefins, in order to meet various quality specifications. As used herein the term "olefinic compound" or "olefinic material" is intended to refer to both mono-olefins and multi-olefins. Olefinic compounds may be objectionable in aromatic hydrocarbons at even very low concentrations of less than a few weight parts per million (wppm) for some processes such as nitration of benzene.

The term "mono-olefins" as used herein means olefinic compounds containing one carbon-carbon double bond per molecule. Examples of mono-olefins are ethylene, propylene, butenes, hexenes, styrene, and octenes. The term "multi-olefins" used herein means olefinic compounds containing at least two carbon-carbon double bonds per molecule. Examples of multi-olefins are butadienes, cyclopentadienes, and isoprenes.

More recently, molecular sieves, and particularly zeolites, have been proposed as replacements for clays in the removal of olefinic compounds from aromatic hydrocarbon feedstocks. U.S. Pat. No. 6,368,496 (Brown et al.) discloses a method for removing bromine reactive hydrocarbon contaminants from aromatic streams by first providing an aromatic feedstream having a negligible diene level. The feedstream is contacted with an acid active catalyst composition under conditions sufficient to remove mono-olefins. An aromatic stream may be pretreated to remove dienes by contacting the stream with clay, hydrogenation or hydrotreating catalyst under conditions sufficient to substantially remove dienes but not mono-olefins.

U.S. Pat. No. 6,500,996 (Brown et al.) discloses a method for the removal of hydrocarbon contaminants, such as dienes and olefins, from an aromatics reformate by contacting an aromatics reformate stream with a hydrotreating catalyst and/or a molecular sieve. The hydrotreating catalyst substantially converts all dienes to oligomers and partially converts olefins to alkylaromatics. The molecular sieve converts the olefins to alkylaromatics. The process provides an olefin depleted product which can be passed through a clay treater to substantially convert the remaining olefins to alkylaromatics. The hydrotreating catalyst has a metal component of nickel, cobalt, chromium, vanadium, molybdenum, tungsten, nickel-molybdenum, cobalt-nickel-molybdenum, nickel-tungsten, cobalt-molybdenum or nickel-tungsten-titanium, with a nickel molybdenum/alumina catalyst being preferred. The molecular sieve is an intermediate pore size zeolite, preferably MCM-22. The clay treatment can be carried out with any clay suitable for treating hydrocarbons.

Aromatic feedstocks having high $C_8$ aromatics (ethylbenzene, para-xylene, meta-xylene, and ortho-xylene), which typically are xylene plant feedstocks for producing para-xylene, ortho-xylene, or mix-xylenes, may be obtained by distillation of reformate streams. Bromine reactive compounds co-boiling with $C_8$ aromatics result in high BI for the $C_8$ aromatic feedstocks. The xylene plant processes and products (e.g., para-xylene) have certain BI requirements or specifications. Conventionally, xylene plant feedstock is treated with an acid treated clay to remove co-boiling olefinic compound(s) under conditions having a temperature range from about 160° C. to about 200° C. and a pressure range from about 1480 to about 2859 kPa-a. Undesired side reactions, e.g., transalkylation or disproportionation, may form benzene as a by-product, which may be a problem for downstream processes, such as separation process by PAREX™. These side reactions are a common problem at the beginning of the process (start-of-run) with the commercial acid treated clay catalysts. After several days on stream, acid treated clay catalysts are highly selective for BI reduction versus transalkylation and disproportionation. The products from commercial xylenes clay treaters typically have benzene levels no more than 30 wppm higher than the benzene in the feed. However, the acid treated clay catalysts have poor stability and catalyst lifetime. As a result, large quantities of acid treated clay are required and must be replaced regularly (typically, every 3 to 12 months for xylene plant feedstocks). Unlike clay catalysts, molecular sieves are known to have high activity for BI reduction, which results in long catalyst lifetime (cycle-length) and high capacity. However, molecular sieves are also known to have high activity for aromatics disproportionation and transalkylation reactions.

For this reason, a need exists for an improved process for reducing BI for xylene plant feedstock that has similar excellent selectivity for BI reduction as clay catalyst but has improved catalyst lifetime. The present invention solves this problem by advantageously contacting the aromatic feedstock with a catalyst comprising a molecular sieve having a zeolite structure type of MWW.

SUMMARY OF THE INVENTION

In one embodiment, the present invention relates to a process for reducing the Bromine Index of a hydrocarbon feedstock having at least 50 wt. % of $C_8$ aromatics, comprising the step of contacting the hydrocarbon feedstock with a catalyst at conversion conditions, wherein the catalyst includes a molecular sieve having a zeolite structure type of MWW.

In another embodiment, the present invention provides a process for reducing the Bromine Index of a hydrocarbon feedstock having at least 50 wt. % $C_8$ aromatics, less than 0.5 wt. % toluene, and less than 0.1 wt. % benzene, comprising the steps of:

(a) contacting the hydrocarbon feedstock with a catalyst comprising a molecular sieve having a zeolite structure type of MWW at conversion conditions to form a product; and (b) withdrawing the product, wherein the concentration of benzene in the product is less than 1000 wppm higher than the concentration of benzene in the feedstock.

In yet another embodiment, the present invention relates to a process for reducing the Bromine Index of a hydrocarbon feedstock having at least 95 wt. % $C_8$ aromatics, less than 0.1 wt. % benzene, less than 1 wt. % toluene, and a Bromine Index of at least 100, comprising the step of contacting the hydrocarbon feedstock with a catalyst at conversion conditions, wherein the catalyst comprises a molecular sieve having a zeolite structure type of MWW, and the conversion conditions comprise a temperature range from about 150° C. to about 270° C., a pressure range from about 136 kpa-a to about 6996 kpa-a, and a WHSV range from about 0.2 $hr^{-1}$ to about 100 $hr^{-1}$.

In another embodiment, the present invention provides a process for reducing the Bromine Index of a hydrocarbon feedstock having at least 50 wt. % of $C_8$ aromatics, less than 0.1 wt. % benzene, and less than 1 wt. % toluene, comprising the steps of:

(a) retrofitting an existing clay treater with a catalyst including a molecular sieve having a zeolite structure type of MWW; and (b) contacting the hydrocarbon feedstock with the catalyst at conversion conditions, wherein the conversion conditions comprise a temperature range from about 150° C. to about 270° C., a pressure range from about 136 kpa-a to about 6996 kPa-a, and a WHSV from about 0.2 $hr^{-1}$ to about 100 $hr^{-1}$, and the hydrocarbon feedstock has a flowrate of at least 100 kg per day.

These and other facets of the present invention shall become apparent from the following detailed description, figure, and appended claims.

DETAILED DESCRIPTION OF THE INVENTION

Figure 1A:
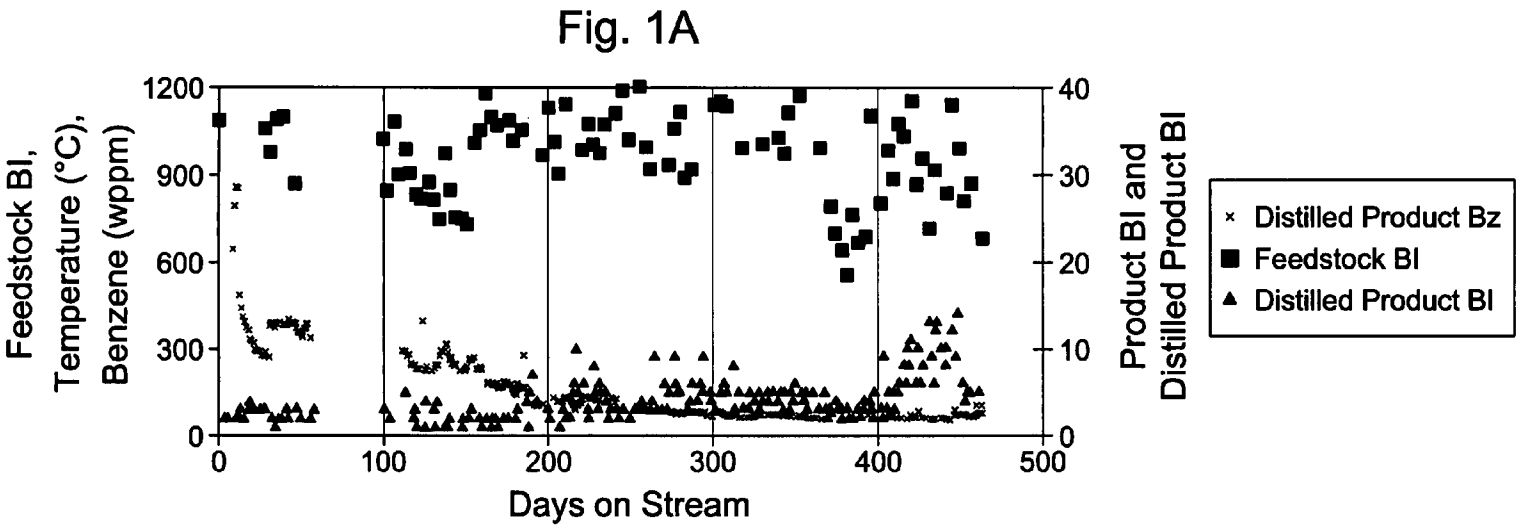
FIG. 1A and FIG. 1B plot the feedstock BI, product (treated feedstock) BI, distilled product BI, temperature of the testing, and the benzene co-product in the distilled product vs. time-on-stream for MCM-22/clay catalyst (Example 1).

All patents, patent applications, test procedures, priority documents, articles, publications, manuals, and other documents cited herein are fully incorporated by reference to the extent such disclosure is not inconsistent with the present invention and for all jurisdictions in which such incorporation is permitted.

When numerical lower limits and numerical upper limits are listed herein, ranges from any lower limit to any upper limit are contemplated.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The term "on-oil" or "on-stream" as used herein means contacting the feedstock(s) with a catalyst in a reactor e.g., molecular sieve(s), clay(s) or any combination thereof, under conversion conditions. The term "on-oil time" used herein means the time when the catalyst in a reactor is in contact with the feedstock(s) under conversion conditions.

The term "cycle-length" as used herein means the total on-oil time of the clay treater or molecular sieve catalyst before clay/molecular sieve catalyst change-out, rejuvenation, or regeneration. The cycle-length is a function of the hydrocarbon feedstock composition and deactivation rate of the clay/molecular sieve catalyst. In general, high mono-olefinic and/or multi-olefinic compounds and low clay/molecular sieve bed capacity will have a short cycle-length.

The term "BI selectivity" as used herein means the catalytic selectivity of the catalyst towards to the desired reaction, i.e., the BI reduction, over the overall reactions, i.e., the total of the desired reaction and undesired reactions (transalkylation and disproportionation). The BI selectivity may be measured by dividing the overall BI reduction activity by the sum of BI reduction activity and all other catalytic activities, such as, activities of transalkylation and disproportionation.

Feed

The aromatics include, for example, benzene, toluene, xylene, ethylbenzene, and other aromatics derived, e.g., from reformate. Reformate is separated by distillation into light reformate (mostly benzene and toluene), and heavy reformate (including toluene, ortho-, meta- and para-xylenes and other heavier aromatics such as $C_9$+). After extraction, the light reformate typically contains more than 98 wt. % benzene plus toluene. Heavy reformate feedstocks typically contain less than 0.5 wt. % toluene and less than 250 wppm benzene. Some aromatic streams such as heavy reformate derived from semi-regen and continuous catalyst regeneration (CCR™) reforming processes contain multi-olefins as they emerge from the processing.

Hydrocarbon feedstocks for xylene plants comprise at least 40 wt. % $C_8$ aromatics, e.g., para-xylene, ortho-xylene, meta-xylene, and ethylbenzene. Preferably, the hydrocarbon feedstocks comprise at least 50 wt. % $C_8$ aromatics, more preferably at least 60 wt. % $C_8$ aromatics, optionally, at least 70 wt.

% $C_8$ aromatics. Such hydrocarbon feedstocks may include less than 50 wt. % toluene and benzene, preferably less than 10 wt. % toluene and benzene, and more preferably less than 2.5 wt. % toluene and benzene, most preferably less than 1 wt. % benzene. Optionally, the hydrocarbon feedstocks comprise less than 0.5 wt. % benzene and/or less than 2 wt. % toluene, preferably less than 1 wt. % toluene. In a preferred embodiment, the hydrocarbon feedstocks comprise less than 0.1 wt. % benzene, preferably less than 0.1 wt. % benzene and less than 0.5 wt. % toluene.

Hydrocarbon feedstocks such as xylene plant feedstocks can be obtained from reforming and steam cracking processes. The hydrocarbon feedstocks include, e.g., paraffins, aromatics, and bromine-reactive compounds such as olefins. For example, aromatic hydrocarbon feedstocks include mononuclear aromatic hydrocarbons and undesirable olefins including mono-olefins, multi-olefins, and styrene, which have an initial BI from about 100 to about 3000.

Because the exact nature of the unsaturated hydrocarbons may vary and may even be unknown, indirect methods of measuring the unsaturated hydrocarbons are typically used. One well-known method of measuring trace amounts of unsaturated hydrocarbons is the BI. The measurement of BI is described in detail in ASTM D2710-92, the entire contents of which are incorporated herein by reference. The BI indirectly measures the olefin content of aromatic containing hydrocarbon samples using potentiometric titration. Specifically, the BI is defined as the number of milligrams of bromine consumed by 100 grams of hydrocarbon sample under given conditions.

The amount of multi-olefins in a hydrocarbon feedstock may vary from less than 10 wt. %, preferably less than 1 wt. %, more preferably less than 500 wppm depending on the source of feedstock and any pre-treatment. Extracted benzenes and heavy reformates typically contain less than 1000 wppm multi-olefins.

The hydrocarbon feedstocks to be processed according to the invention contain bromine-reactive hydrocarbon compounds from about 0.001 to about 10 wt. %, preferably from about 0.001 to about 1.5 wt. %, more preferably from about 0.005 to about 1.5 wt. % or a BI from about 2 to about 20000, preferably from about 2 to about 3000, more preferably from about 10 to about 3000 or most preferably at least 50 to about 3000.

The hydrocarbon feedstock after processing according to the invention will have lower BI than the BI of the hydrocarbon feedstock. In one embodiment the hydrocarbon feedstock processed according to the invention has a BI no greater than 50%, preferably no greater than 20%, more preferably no greater than 10%, of the BI of the hydrocarbon feedstock.

In a preferred embodiment, at least a portion of the treated hydrocarbon feedstock recycles to the catalyst bed at the conversion conditions or to another catalyst bed such as a catalyst comprising at least one molecular sieve having a channel size ranging from about 2 Å to 19 Å, a clay, and any combination thereof. Preferably at least 5 wt. %, more preferably at least 10 wt. %, yet more preferably at least 20 wt. %, even more preferably at least 30 wt. %, and most preferably at least 40 wt. % of the treated hydrocarbon feedstock recycles to the catalyst bed at the conversion conditions. Recycling the product back-mixes the product with the feedstock. By recycling a portion of treated hydrocarbon feedstock to the catalyst bed, the impurities (e.g., diene) in the combined feedstock is lowered because of the low impurities content in the treated hydrocarbon stream. The greater the recycle ratio, the closer the reactor approaches operating like a continuous stir tank reactor (CSTR). While not intended to be bound by the theory, we believe that the dienes in the feedstock are more than 10 times more reactive than the olefins. Operating the reactor like a CSTR reduces the concentration of dienes in the feedstock. Reduced diene concentration reduces the probability of reactions between dienes, which are believed to have a higher selectivity for coke. As a result, using recycle can extend catalyst cycle-length. Longer catalyst cycle-length may lower the cost of the catalyst.

In one embodiment, the present invention has a hydrocarbon feedstock flowrate of at least 10 kg per day, preferably more than at least 100 kg per day, more preferably at least 200 kg per day.

Process Conditions

The reaction for catalytically removing bromine-reactive compounds can be any reaction effectively reducing BI. Examples of these reactions are: polymerization of olefinic compounds, alkylation of paraffins and/or aromatics with olefinic compounds, and saturation and/or hydroxylation of the carbon-carbon double bonds of the olefinic compounds in the hydrocarbon feedstocks.

In accordance with the present invention, the above described hydrocarbon feedstocks may be contacted with a catalyst comprising a molecular sieve having a zeolite structure type of MWW under suitable conversion conditions to remove multi-olefins and mono-olefins. Examples of these conversion conditions include a temperature of from about 38° C. to about 538° C., preferably 93° C. to about 371° C., more preferably 150° C. to about 270° C., to a pressure of from about 136 kpa-a to about 6996 kpa-a, preferably from about 205 kpa-a to about 5617 kpa-a, more preferably from about 205 kPa-a to about 3549 kpa-a, a weight hourly space velocity (WHSV) from about 0.1 $hr^{-1}$ and about 200 $hr^{-1}$, preferably from about 0.2 $hr^{-1}$ and about 100 $hr^{-1}$, more preferably from about 1 $hr^{-1}$ and about 50 $hr^{-1}$. The WHSV is based on the total weight of catalyst, i.e., the total weight of active catalyst plus any binder that is used.

In one embodiment of this invention, the catalyst may be located in a single reactor vessel. In another embodiment, the catalyst may be located in a reactor system comprising at least two reactor vessels connected in parallel, in series, or any combination thereof.

In one embodiment, this invention relates to a process retrofitting existing clay catalyst reactor ("clay treater") with a catalyst comprising at least one molecular sieve catalyst. In a preferred embodiment, this invention relates to a process replacing at least a portion of existing clay catalyst in an existing clay catalyst reactor with a catalyst comprising at least one molecular sieve catalyst. The preferred embodiment abovementioned may further comprise a step of adding a catalyst comprising at least one molecular sieve catalyst to the existing clay treater. In a preferred embodiment, this invention relates to a process replacing at least 10 wt. %, preferably 25 wt. %, more preferably 50 wt. %, most preferably at least 50 wt. %, existing clay catalyst in an existing clay catalyst reactor with a catalyst comprising a molecular sieve catalyst having a zeolite structure of MWW. In yet another preferred embodiment, this invention relates to a process replacing entire clay catalyst in the existing clay treater with a catalyst comprising at least one molecular sieve catalyst. Another embodiment of this invention comprises a step of adding a catalyst having at least one molecular sieve catalyst to the existing clay treater.

In one embodiment, the catalyst of this invention may further include clay. The molecular sieve catalyst and clay catalyst may have a volume ratio of the molecular sieve catalyst over the clay catalyst range from about 1:99 to about 99:1, and preferably from 10:90 to about 90:10.

In yet another embodiment, the molecular sieve catalyst and clay catalyst may also be packed in separate reactors. When the molecular sieve catalyst and clay catalyst are in separate reactors, each reactor may have different operating conditions. The molecular sieve catalytic and clay catalytic treating zones may be of any type and configuration that is effective in achieving the desired degree of BI reduction. It may utilize either upward or downward flow, with downward flow being preferred. The pressure in the molecular sieve and clay catalyst system zones should be sufficient to maintain at least 90 wt. % of the hydrocarbon feedstock in liquid phase conditions. This will normally be a pressure of about 136 kpa-a to about 13891 kPa-a. Preferably the pressure is set about 345 kPa higher than the vapor pressure of the hydrocarbons at the inlet temperature of the molecular sieve/clay zone. This temperature is preferably within the range of from about 130° C. to about 270° C. The molecular sieve and clay catalytic conversion may be performed over a broad range of weight hourly space velocities (WHSV). This variable is often set by the desired on-stream life of the molecular sieve and clay and may range from less than 0.5 $hr^{-1}$ to about 100 $hr^{-1}$, preferably from about 0.5 $hr^{-1}$ to about 10 $hr^{-1}$, more preferably from 1.0 $hr^{-1}$ to 4.0 $hr^{-1}$ depending on the hydrocarbon feedstock being treated.

Catalyst

It is contemplated that any porous particulate materials having a pore size appropriate to catalytically removing bromine-reactive compounds can be employed in the process of this invention. The porosity, pore size and pore size distribution in large pores (meso- and macropores) are often of major significance, especially when mass transport affects process performance. The surface properties of the porous particulate material can also be very important for the performance of the material in a given application. The morphology of the porous particulate material (e.g., molecular sieves) can also be another important factor for the performance of the material in this invention. For example, a morphology of small particle size or a morphology of thin layering/plate material can have a large accessible interface. Optionally, the molecular sieve (s) used in this invention has a morphology of small particle size such as an average particle size less than 1 μm, preferably less than 0.1 μm, more preferably less than 0.05 μm or a thin layering/plate morphology having a ratio of the thickness over the average of the other two dimensions less than 0.5, preferably less than 0.1, more preferably less than 0.05, more preferably less than 0.01, more preferably less than 0.005, more preferably less than 0.001.

Microporous particulate materials include crystalline molecular sieves. Molecular sieves are characterized by the fact that they are microporous particulate materials with pores of a well-defined size ranging discretely from about 2 Å to about 20 Å. Most organic molecules, whether in the gas, liquid, or solid phase, have dimensions that fall within this range at room temperature. Selecting a molecular sieve composition with a suitable and discrete pore size therefore allows separation of specific molecules from a mixture with other molecules of a different size through selective adsorption, hence the name "molecular sieve". Apart from the selective adsorption and selective separation of uncharged molecular sieve particles, the well-defined and discrete pore system of a molecular sieve enables selective ion exchange of charged particles and selective catalysis. In the latter two cases, significant properties other than the micropore structure include, for instance, ion exchange capacity, specific surface area and acidity.

A summary of existing technology, in terms of production, modification and characterization of molecular sieves, is described in the book "Molecular Sieves—Principles of Synthesis and Identification"; (R. Szostak, Blackie Academic & Professional, London, 1998, Second Edition). In addition to molecular sieves, amorphous materials, chiefly silica, aluminum silicate and aluminum oxide, have been used as catalyst supports. A number of long-known techniques, such as spray drying, prilling, pelletizing and extrusion, have been and are being used to produce macrostructures in the form of, for example, spherical particles, extrudates, pellets and tablets of both micropores and other types of porous materials for use in catalysis, adsorption and ion exchange. A summary of these techniques is described in "Catalyst Manufacture," A. B. Stiles and T. A. Koch, Marcel Dekker, New York, 1995.

Intergrown molecular sieve phases are disordered planar intergrowths of molecular sieve frameworks. These are generally described in the "Catalog of Disordered Zeolite Structures", 2000 Edition, published by the Structure Commission of the International Zeolite Association and to the "Collection of Simulated XRD Powder Patterns for Zeolites", M. M. J. Treacy and J. B. Higgins, 2001 Edition, published on behalf of the Structure Commission of the International Zeolite Association for a detailed explanation on intergrown molecular sieve phases.

Regular crystalline solids are periodically ordered in three dimensions. Structurally disordered structures show periodic ordering in dimensions less than three, i.e., in two, one or zero dimensions. This phenomenon is called stacking disorder of structurally invariant Periodic Building Units. Crystal structures built from Periodic Building Units are called end-member structures if periodic ordering is achieved in all three dimensions. Disordered structures are those where the stacking sequence of the Periodic Building Units deviates from periodic ordering up to statistic stacking sequences.

The catalyst used in this invention may be an intergrown molecular sieve phases having at least a portion of said intergrown molecular sieve phases comprising a zeolite structure type of MWW. Preferably at least 1 wt. %, more preferably at least 50 wt. %, even more preferably at least 95 wt. %, and most preferably at least 99 wt. % of the intergrown molecular sieve phases comprises a molecular sieve having a zeolite structure type of MWW.

The term "fresh molecular sieve" as used herein means a molecular sieve that has not been exposed for a substantial amount of time (such as 24 hours) to hydrocarbon feedstocks under conversion conditions. Examples of fresh molecular sieve are newly synthesized MCM-22 before or after calcination. The term "spent molecular sieve" used herein, means a non-fresh molecular sieve, i.e., a molecular sieve has been exposed for a substantial amount of time (such as 24 hours) to hydrocarbon feedstocks under conversion conditions. Examples of spent molecular sieves are regenerated or rejuvenated MCM-22 after being exposed to a transalkylation feedstock under transalkylation conditions or an alkylation feedstock under alkylation conditions. Typically, a spent molecular sieve has lower catalytic activity than the corresponding fresh molecular sieve.

Molecular sieves/zeolites useful in the present invention include any of the naturally occurring or synthetic crystalline molecular sieves. Examples of these zeolites include large pore zeolites, intermediate pore size zeolites, and small pore zeolites. These zeolites and their isotypes are described in "Atlas of Zeolite Structure Types", Eds. W. H. Meier, D. H. Olson and Ch. Baerlocher, Elsevier, Fourth Edition, 1996, the contents of which is hereby incorporated by reference. A large pore zeolite generally has a pore size of at least about 7 Å and includes LTL, VFI, MAZ, MEI, FAU, EMT, OFF, *BEA, MTW, MWW, and MOR structure type zeolites (IU- PAC Commission of Zeolite Nomenclature). Examples of large pore zeolites include mazzite, offretite, zeolite L, VPI-5, zeolite Y, zeolite X, omega, Beta, ZSM-3, ZSM-4, ZSM-18, ZSM-20, SAPO-37, and MCM-22. An intermediate pore size zeolite generally has a pore size from about 5 Å to about 7 Å and includes, for example, MFI, MEL, MTW, EUO, MTT, MFS, AEL, AFO, HEU, FER, and TON structure type zeolites (IUPAC Commission of Zeolite Nomenclature). Examples of intermediate pore size zeolites include ZSM-5, ZSM-11, ZSM-12, ZSM-22, ZSM-23, ZSM-34, ZSM-35, ZSM-385, ZSM-48, ZSM-50, ZSM-57, silicalite 1, and silicalite 2. A small pore size zeolite has a pore size from about 3 Å to about 5.0 Å and includes, for example, CHA, ERI, KFI, LEV, SOD, and LTA structure type zeolites (IUPAC Commission of Zeolite Nomenclature). Examples of small pore zeolites include ZK-4, ZSM-2, SAPO-34, SAPO-35, ZK-14, SAPO-42, ZK-21, ZK-22, ZK-5, ZK-20, zeolite A, hydroxysodalite, erionite, chabazite, zeolite T, gmelinite, ALPO-17, and clinoptilolite.

The molecular sieve useful for this invention is usually a large pore size zeolite having a silica-to-alumina molar ratio of at least about 2, specifically from about 2 to 100. The silica to alumina ratio is determined by conventional analysis. This ratio is meant to represent, as closely as possible, the molar ratio in the framework of the molecular sieve and to exclude silicon and aluminum in the binder or in cationic or other form within the channels.

In one embodiment, the molecular sieves for selectively removing mono-olefinic and multi-olefinic compounds include, e.g., large pore zeolites, particularly a molecular sieve having a zeolite structure type of MWW, e.g., MCM-22 (U.S. Pat. No. 4,954,325), MCM-49 (U.S. Pat. No. 5,236,575), MCM-56 (U.S. Pat. No. 5,362,697), and ITQ-1 (U.S. Pat. No. 6,077,498). Preferred catalysts include at one of MCM-22, MCM-49, MCM-56, or ITQ-1. Most preferred are the MCM-22 family of molecular sieves, which includes MCM-22, MCM-49 and MCM-56. The MCM-22 type materials may be considered to contain a similar common layered structure unit. The structure unit is described in U.S. Pat. Nos. 5,371,310, 5,453,554, 5,493,065 and 5,557,024. Each of the patents in this paragraph describing molecular sieve materials is herein incorporated by reference.

In another embodiment, other natural or synthetic crystalline molecular sieves, with ring structures of ten to twelve members or greater, may also be used together with the molecular sieve having a zeolite structure type of MWW. Crystalline molecular sieves useful as catalysts include as non-limiting examples, large pore zeolites ZSM-4 (omega) (U.S. Pat. No. 3,923,639), mordenite, ZSM-18 (U.S. Pat. No. 3,950,496), ZSM-20 (U.S. Pat. No. 3,972,983), zeolite Beta (U.S. Pat. Nos. 3,308,069 and Re 28,341), Faujasite X (U.S. Pat. No. 2,882,244), Faujasite Y (U.S. Pat. No. 3,130,007), USY (U.S. Pat. Nos. 3,293,192 and 3,449,070), REY and other forms of X and Y, and mesoporous materials such as M41 S (U.S. Pat. No. 5,102,643) and MCM-41 (U.S. Pat. No. 5,098,684). More preferred molecular sieves include 12 membered oxygen-ring structures ZSM-12, mordenite, Zeolite Beta, USY, layered materials, and mesoporous materials.

Acidic catalysts may catalyze both BI reduction reactions, e.g., alkylation or polymerization of olefinic compounds, and side reactions, e.g., disproportionation of toluene and/or transalkylation of xylenes. The by-products of these undesired side reactions, e.g., benzene may be a problem for many downstream processes, such as, PAREX™. The catalyst of this invention is surprisingly selective to the BI reduction reaction and substantially free of undesired by-products, e.g., benzene. The term "substantially free of undesired by-products" used herein means the concentration of the by-products in the product effluent is less than 1000 wppm, preferably less than 500 wppm, higher than the concentration of the by-products in the feed. In one embodiment, the concentration of benzene in the product effluent is less than 1000 wppm, preferably less than 500 wppm, higher than the concentration of benzene in the feed.

Because of the catalyst of this invention has high selectivity to BI reduction reactions and low selectivity to the side reactions, such as producing coke and benzene, the catalyst of this invention may operate at more severe conversion conditions, e.g., high temperature and high space velocity, than the conventional clay catalyst. Clay catalysts typically operate at or below 210° C. The catalyst of the invention preferential continues operation out to greater than 240° C. to as high as 270° C. The catalyst of this invention therefore has longer cycle-length, wider operating window, and higher throughput potential. As shown in the examples, it is possible to secure 10-fold or greater cycle-length improvements through use of the present invention. The advantage of increased cycle length at constant conditions can often be traded for higher throughput at similar cycle lengths. Thus the process of the invention provides for debottleneck potentials for existing plants using clay as catalyst in clay treaters. Alternatively, the process of the invention can be used to save on capital costs for new clay treaters. The process of the invention can achieve a typical clay cycle length (about 3 to about 12 months) using as little as $1/10^{th}$ the weight of the conventional acid treated clay. The process of the invention also relieves the environmental burden of current clay systems. Furthermore, the zeolite catalyst of the invention is regenerable and can be used many times.

In one embodiment, the catalyst of this invention has a cycle-length of at least one month, preferably at least 2 months, more preferably at least 3 months, yet more preferably at least 5 months, even more preferably at least 10 months, and most preferably at least 14 months.

One measure of the acid activity of a zeolite is the Alpha Value. The Alpha Value is an approximate indication of the catalyst acid activity and it gives the relative rate constant (rate of normal hexane conversion per volume of catalyst per unit time). It is based on the activity of the highly active silica-alumina cracking catalyst taken as an Alpha of 1 (Rate Constant=0.16 $sec^{-1}$). The Alpha Value is described in U.S. Pat. No. 3,354,078, in the Journal of Catalysis, Vol. 4, p. 527 (1965); Vol. 6, p. 278, and Vol.; 61, p. 395 (1980), each of which is herein incorporated by reference as to that description. The experimental conditions of the test used include a constant temperature of 538° C., and a variable flow rate as described in the Journal of Catalysis, Vol. 61, p. 395 (1980).

In one embodiment, the molecular sieve(s) has an Alpha Value of at least 1, preferably at least 10, more preferably at least 100, more preferably at least 300.

The crystalline molecular sieve may be used in bound form, that is, composited with a matrix material, including synthetic and naturally occurring substances, such as clay, silica, alumina, zirconia, titania, silica-alumina and other metal oxides. Other porous matrix materials include silica-magnesia, silica-zirconia, silica-thoria, silica-beryllia, silica-titania, as well as ternary compositions such as silica-alumina-thoria, silica-alumina-zirconia, silica-alumina-magnesia, and silica-alumina-zirconia. The catalyst can be used in the form of an extrudate, lobed form (e.g. trilobe), or powder.

The clay catalyst useful for this application is usually an acidic naturally-occurring clay or a synthetic clay material. Naturally-occurring clays include those of the montmorillonite and kaolin families. Clay catalyst system is used herein to refer to the passage of a hydrocarbon stream through a fixed bed of contact material, which possesses the capability of reacting olefinic compounds present in the hydrocarbon stream. Preferably the contact material is an acidic aluminosilicate. It may be either a naturally occurring material, such as bauxite or mordenite clay, or a synthetic material and may comprise alumina, silica, magnesia or zirconia or some other compound, which exhibits similar properties. A preferred clay is F-24 clay produced by Engelhard Corporation. However, several other types of clay are available commercially and are suitable for use in the present invention, including Filtrol 24, Filtrol 25 and Filtrol 62 produced by the Filtrol Corporation, Attapulgus clay and Tonsil clay. In a preferred embodiment, the clays are pretreated with concentrated HCl or $H_2SO_4$ acid.

As previously discussed, clay catalyst system is now conducted over a wide temperature range of from about 93° C. to about 371° C. The conditions utilized in the clay catalyst system are dependent on the hydrocarbon feedstocks and the kind of the clay catalyst used.

Depending on the hydrocarbon feedstock and the operating conditions, two or more separate clay treater vessels can be used on an alternating (i.e., swing) basis to provide continuous operation. A clay reactor can also be used as the swing reactor for the molecular sieve bed when the molecular sieve is being replaced or regenerated.

Surprisingly, molecular sieves with structure type MWW have prove to have both breakthrough stability and outstanding selectivity. Excellent selectivity is a key to the breakthrough stability of the MWW catalysts. The improved BI reduction process with MWW catalysts can be advantageously operated to a higher end of cycle temperature than the conventional processes using acid-treated clay. Clay treaters for xylene plants feedstocks typically have an end of cycle temperature below 210° C. Higher temperature operation increases benzene co-product and does not significantly extend clay cycle length. The improved process may be able to operate at temperatures up to 270° C. without increasing the amount of benzene in the unit product by more than 1000 wppm. Higher temperature operation is known to extend MCM-22 catalyst lifetime. Because of the unexpected selectivation with time on stream MCM-22 is expected to be able to continue operation out to 270° C. while still meeting the benzene co-product specification for downstream processes, e.g., PAREX™.

The molecular sieve and/or clay may be regenerated under regeneration conditions. In one embodiment of the present invention, the molecular sieve and/or clay is regenerated under regenerating conditions comprising a temperature range of about 30 to 900° C., a pressure range of about 10 to 20000 kPa-a, and a WHSV from about 0.1 $hr^{-1}$ to about 1000 $hr^{-1}$, wherein the regenerating conditions comprise a feed having an oxidative reagent such as air, oxygen, and nitrogen oxides.

The molecular sieve and/or clay may be rejuvenated under rejuvenation conditions. In another embodiment of the present invention, the molecular sieve and/or clay is rejuvenated under rejuvenating conditions comprising a temperature range of about 30° C. to about 900° C., a pressure range of about 10 to 20000 kPa-a, and a WHSV from about 0.1 $hr^{-1}$ to about 1000 $hr^{-1}$, wherein the rejuvenating conditions comprise a feed having a reductive reagent, such as hydrogen, $He/H_2$, or $N_2/H_2$.

The following examples illustrate exemplary preferred embodiments.

Two hydrocarbon feedstocks having different level of olefinic compounds were used in the following examples. These feedstocks were analyzed using standard gas chromatograph ("GC") analysis and the ASTM BI test (BI). The compositions of these feedstocks are listed in Table 1.

TABLE 1

| Hydrocarbon Feedstock | Feed A | Feed B |
|---|---|---|
| BI | 570-1200 | 0 |
| Total olefinic compounds (wppm) | 5200-8400 | 0 |
| Benzene (wppm) | 50 | 0 |
| Toluene (wppm) | 5450 | 10 |
| Ethylbenzene (wt. %) | 9 | About 10 |
| Xylenes (wt. %) | 48 | 90 |
| $C_9$+ (wt. %) | 42 | 0 |
| Others (wt. %) | less than 0.5 | less than 1 |

EXAMPLE 1

Figure 1B:
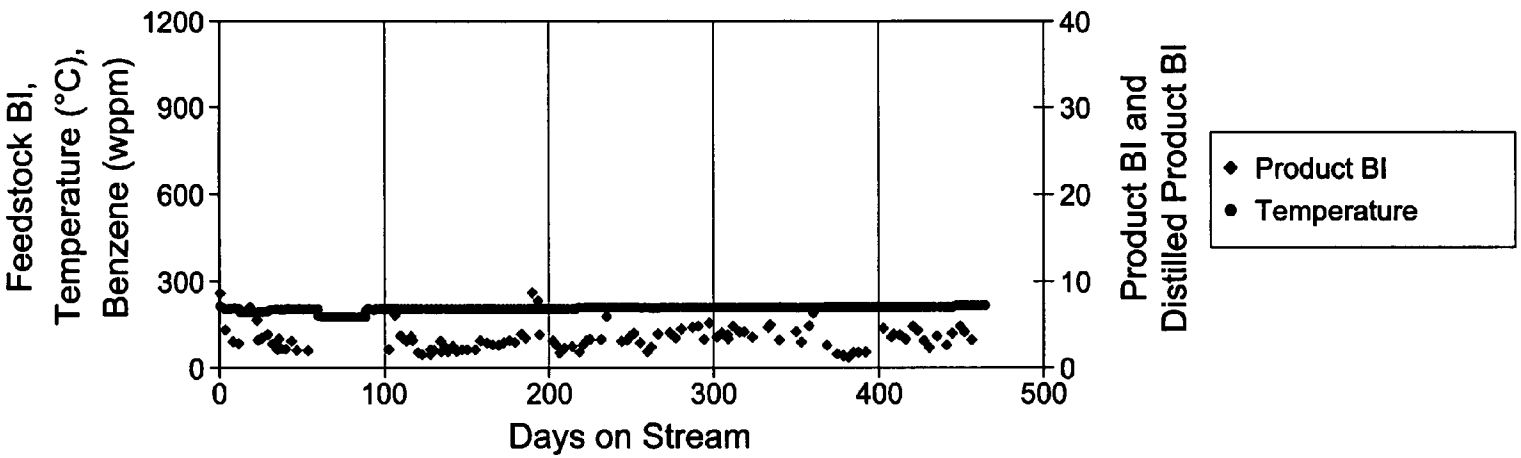

Feed A (Table 1) was treated with a catalyst having 50 vol % MCM-22 catalyst and 50 vol. % F-24 clay in a reactor. The test conditions were 190° C., WHSV 1 $hr^{-1}$, and 1480 kpa-a at start-up. The temperature was raised to maintain catalytic activity for the BI reduction as the catalyst aged over time. The after treated feedstock (product) was further distilled to recover xylenes. The BI and benzene in the xylene stream (distilled product) were measured. The results are shown in FIG. 1. As shown in FIG. 1, the benzene co-product in the distilled product was 800 wppm at the start of the test. The benzene co-product in the distilled product decreased to 500 wppm after 2 months on stream. After 2 months on stream the temperature was raised to 195° C. to improve the BI reduction activity and the benzene co-product in the distilled product increased to 800 wppm. After 6 months on stream the BI reduction activity decreased and the benzene co-product in the distilled product had dropped dramatically to near 180 wppm. Also after 6 months on stream the temperature was raised to 200° C. and the benzene co-product in the distilled product jumped to about 260 wppm. After 14 months on stream the BI reduction activity decreased and the benzene co-product in the distilled product had dropped to below 100 wppm. Also after 14 months on stream the temperature was raised to 205° C. and the benzene co-product in the distilled product increased to 130-150 wppm. The BI in the product was maintained below 10 for the whole testing period. The BI in the distilled product was maintained below 10 for most of the time during the whole testing period. The cycle length for this catalyst was more than 14 months.

EXAMPLE 2 (COMPARATIVE)

Figure 2:
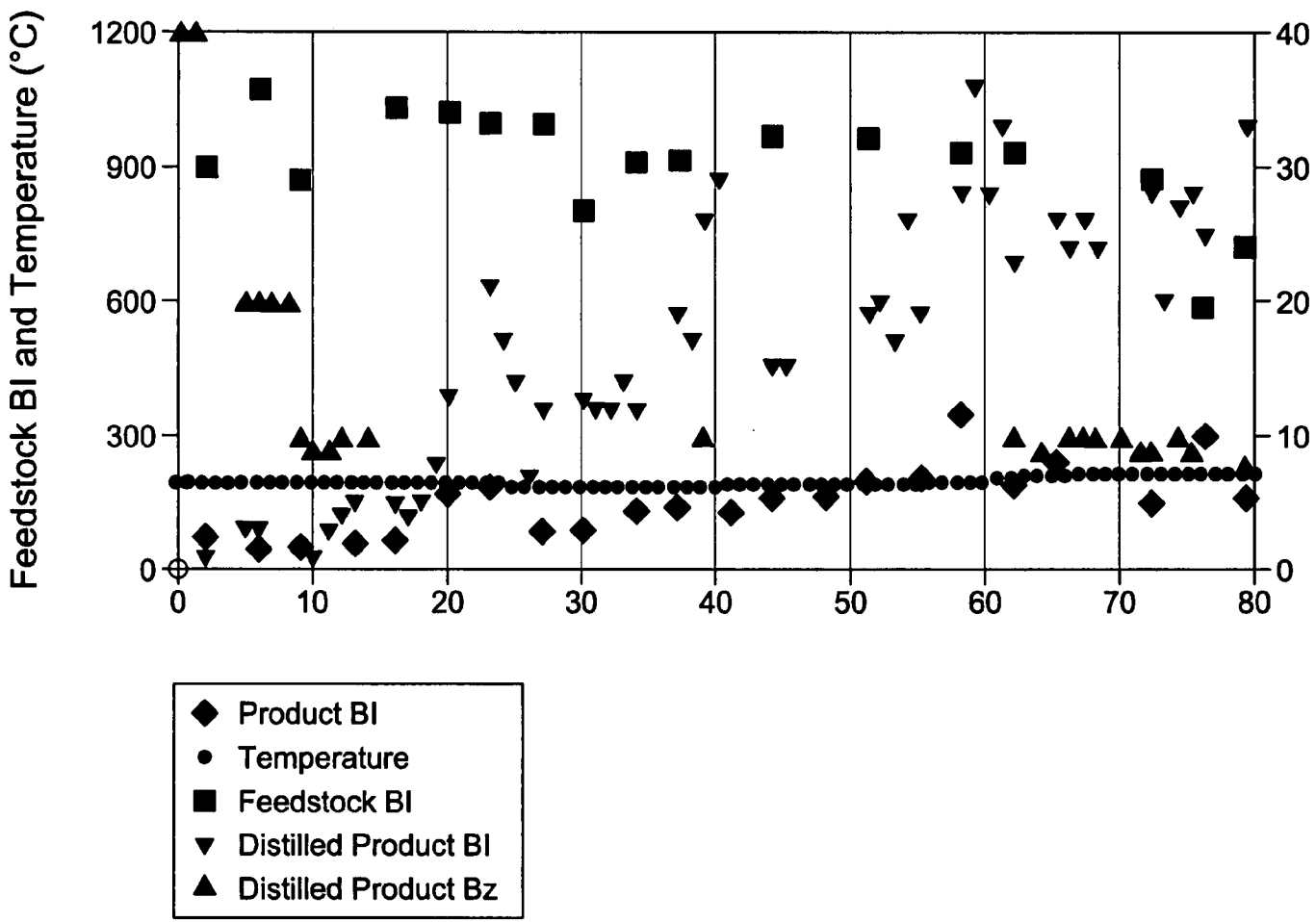
FIG. 2 plots the feedstock BI, product (treated feedstock) BI, distilled product BI, temperature of the testing, and the benzene co-product in the distilled product vs. time-on-stream for clay catalyst (Example 2).

Feed A (Table 1) was treated with 100 vol % F-24 clay. The results are shown in FIG. 2. The starting test conditions were 185° C., WHSV 1 $hr^{-1}$, and 1480 kPa-a. The clay aged steadily and the reactor temperature reached the maximum value of 210° C. within several weeks. The test was shut down due to lack of F-24 activity after 70 days on stream. The amount of benzene byproduct produced averaged less than 20 wppm. The clay catalyst is highly selective for BI reduction with minimal benzene production via feedstock transalkylation. The BI in the product was maintained below about 10 for the whole testing period. However the BI in the distilled product was maintained below 10 only for the first 20 days. The BI in the distilled product was above 10 and below 40 for the last 50 days of the testing period. The cycle length for this catalyst was about 70 days.

The acid treated clay has outstanding selectivity for BI reduction with minimal benzene co-product. The MCM-22 catalyst has high activity for BI reduction and high benzene co-product at the start of cycle. Surprisingly, the MCM-22 catalyst becomes much more selective for the BI reduction with time on stream, and after 8 months on stream the benzene co-product is below 200 wppm. Both acid treated clay and the MCM-22 catalyst is able to reduce BI in the product. However, the MCM-22 catalyst is more selective to remove BI compounds co-boiling with xylenes than the clay catalyst. The average BI of the distilled product (mainly xylenes) treated by the MCM-22 catalyst is lower than the average BI of the distilled product (mainly xylenes) treated by the clay catalyst. The combination of outstanding stability for BI reduction, long catalyst lifetime, and improved selectivity with time on stream make MCM-22 especially useful for reducing the BI of xylenes plant feedstocks.

EXAMPLE 3 (COMPARATIVE)

Feed B was tested with zeolite beta catalyst in a pilot unit. Experiments were run at WHSV of 4 and 12 $hr^{-1}$ and a temperature of 230 and 260° C. The pressure was 2170 kpa-a. The benzene co-product was measured for all four experiments. At 260° C. and WHSV 4 $hr^{-1}$ the benzene co-product was 12500 wppm. At 260° C. and WHSV 12 $hr^{-1}$ the benzene co-product was 800 wppm. At 230° C. and WHSV 4 $hr^{-1}$ the benzene co-product was 3500 wppm. At 230° C. and WHSV 12 $hr^{-1}$ the benzene co-product was 750 wppm.

The data from example 3 indicates that the beta zeolite produces large amounts of benzene co-product at conditions similar to example 1. The data suggests that the activity of zeolite beta for the benzene co-product doubles each time the reactor temperature is raised by 12° C. The benzene co-product at the conditions of Example 1 is projected to be between 1000 and 2000 wppm. Therefore, for BI reduction the zeolite beta catalyst is significantly less selective than MCM-22 which produced lower benzene co-product.

We claim:

1. A process for reducing the Bromine Index of a hydrocarbon feedstock having at least 50 wt. % $C_8$ aromatics, less than 0.5 wt. % toluene, and less than 0.1 wt. % benzene, comprising the steps of:

(a) contacting said hydrocarbon feedstock with a catalyst comprising MCM-22 and clay at conversion conditions to form a product having a reduced Bromine Index when compared with said hydrocarbon feedstock; and (b) withdrawing said product, wherein the concentration of benzene in said product is less than 1000 wppm higher than the concentration of benzene in said feedstock and wherein said product is characterized by a Bromine Index no greater than 50% of the Bromine Index of said hydrocarbon feedstock.

2. The process according to claim 1, wherein the concentration of benzene in said product is less than 500 wppm higher than the concentration of benzene in said feedstock.

3. The process according to claim 1, wherein said catalyst consists of a spent MCM-22 and clay.

4. The process according to claim 1, wherein said conversion conditions comprise a temperature range from about 150° C. to about 270° C., a pressure range from about 136 kPa-a to about 6996 kPa-a, and a WHSV from about 0.2 $hr^{-1}$ to about 100 $hr^{-1}$.

5. The process according to claim 1, wherein said hydrocarbon feedstock has a flowrate of more than at least 100 kg per day.

* * * * *